US005989168A

United States Patent [19]

See

[11] Patent Number: 5,989,168

[45] Date of Patent: Nov. 23, 1999

[54] EXERCISE BED

[76] Inventor: Long-Tan See, 4 Lane 166, Chung Hua See Rd., Chan Hua, Taiwan

[21] Appl. No.: 09/222,772

[22] Filed: Dec. 30, 1998

[51] Int. Cl.[6] ..... A63B 26/00

[52] U.S. Cl. ..... 482/142; 482/4; 482/145; 482/907

[58] Field of Search ..... 402/1, 4, 96, 130, 402/133, 145, 142, 907

[56] References Cited

U.S. PATENT DOCUMENTS 5,716,308 2/1998 Lee ..... 482/130
5,840,001 11/1998 Schedel ..... 482/142
5,902,220 5/1999 Lin ..... 482/142

*Primary Examiner*—John Mulcahy
*Attorney, Agent, or Firm*—Bacon & Thomas

[57] ABSTRACT

An exercise bed is composed of a front bed frame, a rear bed frame fastened pivotally with the front bed frame, a movable frame fastened with the rear bed frame and provided with a plurality of soft rollers arranged at various levels, a transmission motor mounted under the rear bed frame and connected with the movable frame, and an elastic cord fastened under the front bed frame and the rear bed frame. As the transmission motor is started, a pivoting portion of the front bed frame and the rear bed frame is actuated to bulge to urge the backbone and the back muscles of a person lying on the exercise bed.

3 Claims, 3 Drawing Sheets

EXERCISE BED

FIELD OF THE INVENTION

The present invention relates generally to a bed, and more particularly to an exercise bed.

BACKGROUND OF THE INVENTION

The conventional exercise machines can not be used as a bed for sleeping or resting on. The conventional beds can not be used as an exercise device for relaxing or training the muscles of a person. It is therefore practical and economical to have an exercise bed which can be used as an exercise device as well as a bed for a person to sleep or rest on.

SUMMARY OF THE INVENTION

The primary objective of the present invention is to provide an exercise bed consisting of a front bed frame, a rear bed frame fastened pivotally with the front bed frame, a movable frame fastened pivotally with the rear bed frame and provided with a plurality of soft rollers, a motor mounted under the rear bed frame, and an elastic cord fastened under the rear bed frame and the front bed frame. As the motor is started, both front bed frame and the rear bed frame are displaced upwards to push the back muscles of a person resting on the exercise bed.

The objective, features, functions and advantages of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
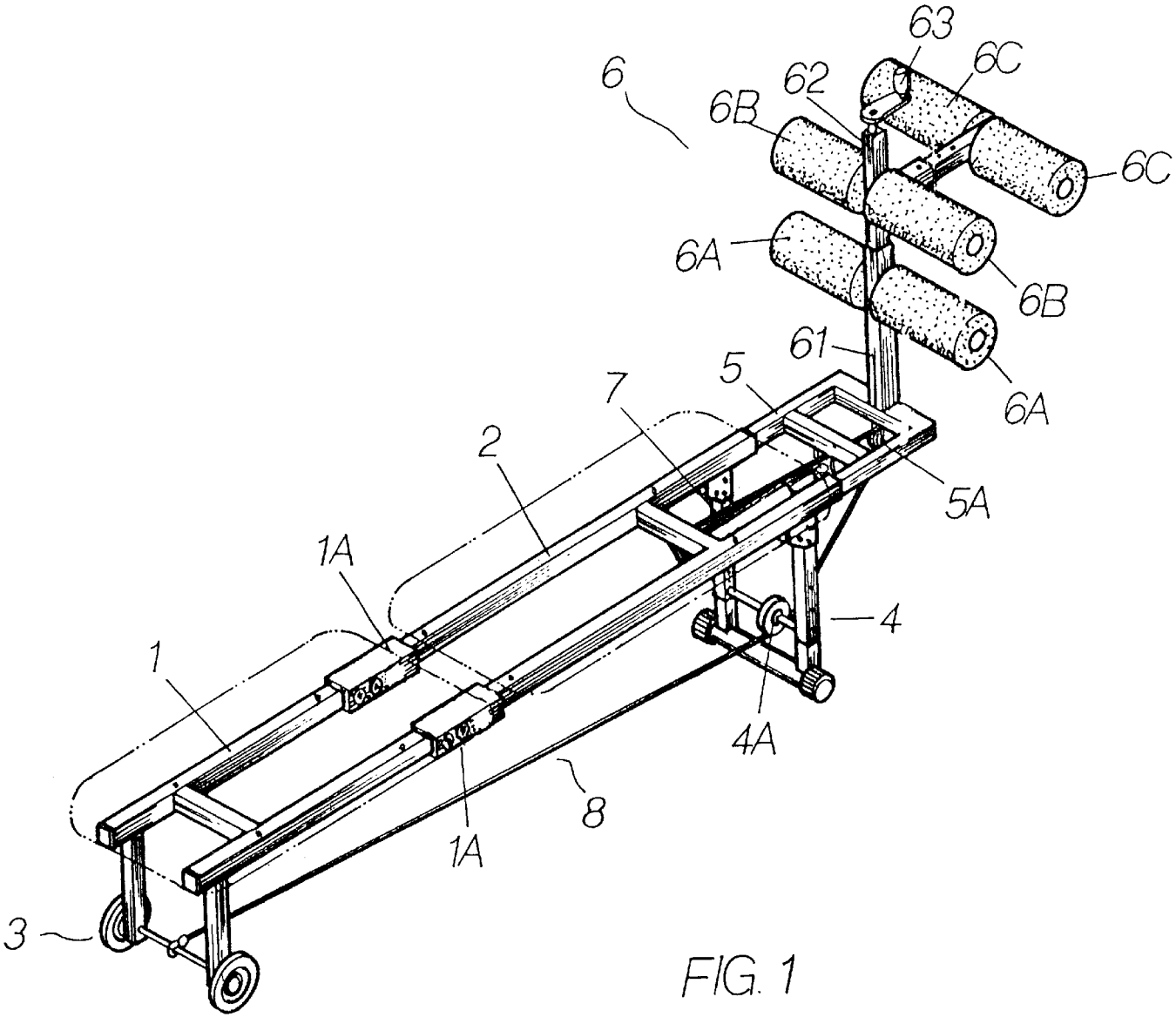
FIG. 1 shows a perspective view of the preferred embodiment of the present invention.
Figure 2:
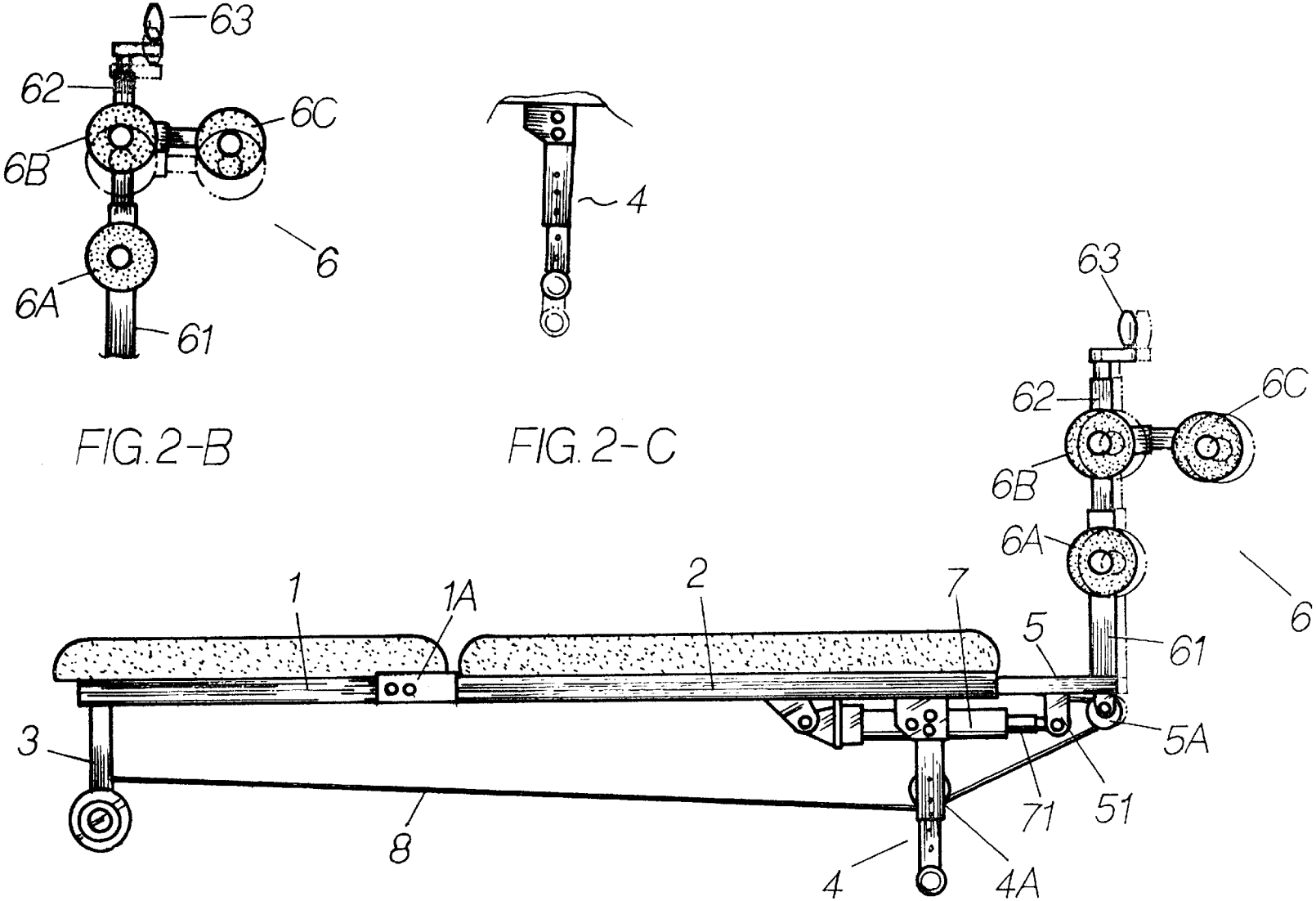
FIG. 2A shows a side elevational view of the preferred embodiment of the present invention.
FIG. 2B shows a schematic view of the soft rollers of the preferred embodiment of the present invention in operation.
FIG. 2C shows a schematic view of support frames of the preferred embodiment of the present invention at work.

As shown in all drawings provided herewith, an exercise bed embodied in the present invention is composed of a front bed frame 1, a rear bed frame 2 fastened pivotally with the front bed frame 1, a plurality of support wheels 3, two support frames 4 supporting the front bed frame 1 and the rear bed frame 2. The rear bed frame 2 is provided at the free end thereof with a movable frame 5 which is in turn provided with a roller adjusting set 6. The rear bed frame 2 is provided in the underside thereof with a transmission motor 7 having a moving rod 71 which is fastened pivotally with a pivoting seat 51 of the movable frame 5. An elastic cord 8 is located under the front bed frame 1 and the rear bed frame 2 such that the elastic cord 8 is fastened at one end thereof with a rotary wheel 5A of the movable frame 5, with the other end of the elastic cord 8 being fastened with the support wheels 3 located under the front bed frame 1. The elastic cord 8 runs through another rotary wheel 4A of the rear support frame 4. The roller adjusting set 6 has a fastening rod 61 to which three sets of soft rollers 6A, 6B and 6C are fastened at different levels. A support rod 62 of the roller adjusting set 6 can be actuated by a rotary wheel 63 to ascend or descend gradually so as to hold both feet A1 of a user "A" between the soft rollers 6A and 6B, and the soles A11 of the user "A" between the soft rollers 6B and 6C. The rear support frame 4 can be adjusted in length, as shown in FIG. 2C, so as to tilt the exercise bed of the present invention.

Figure 3:
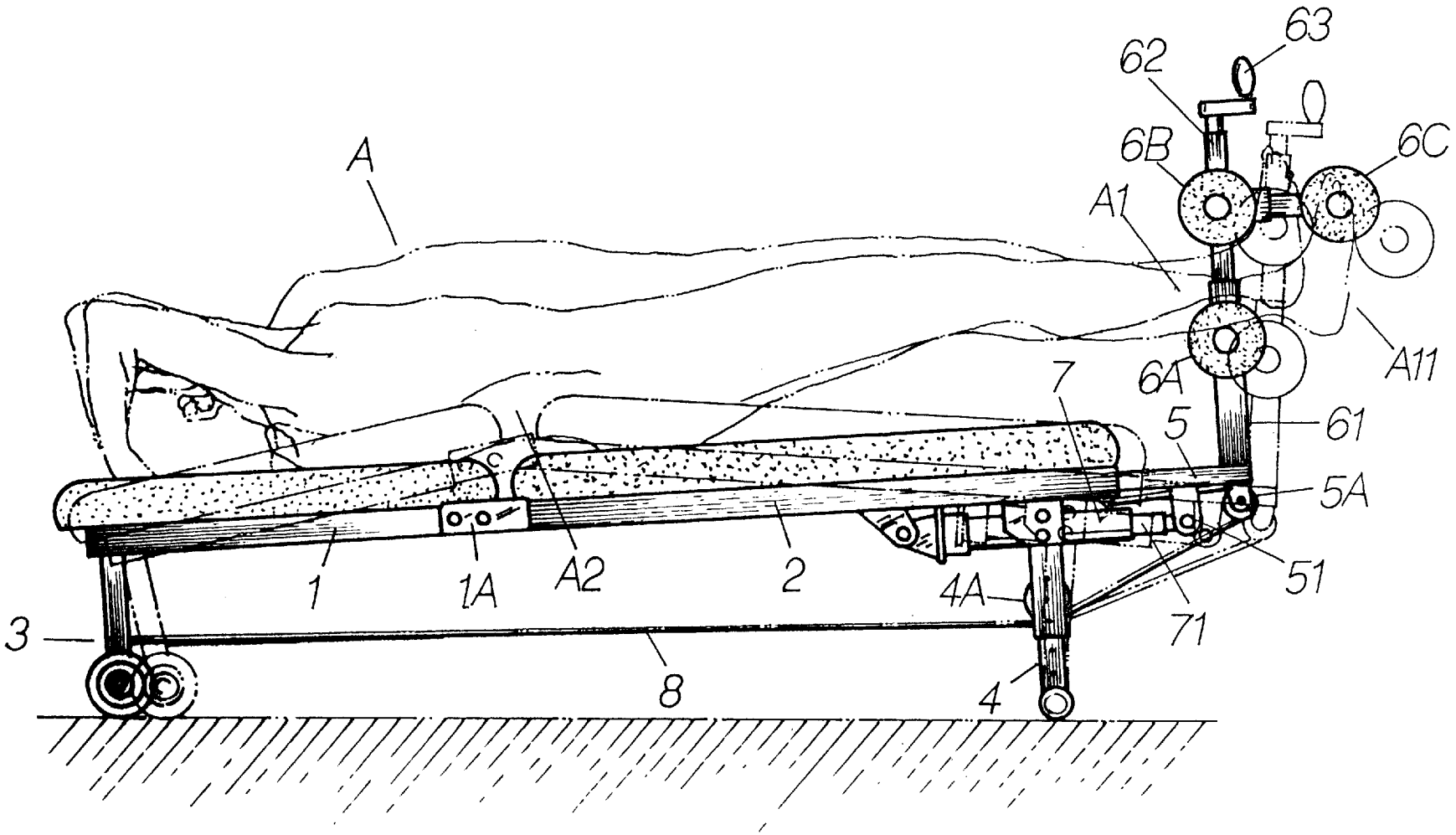
FIG. 3 shows a schematic view of the present invention at work.

As the transmission motor 7 is started, the moving rod 71 is pushed to move away from the motor 7, thereby causing the movable frame 5 to displace likewise. As a result, the roller adjusting set 6 is displaced as shown by the imaginary lines in FIG. 2A. In the meantime, the support wheels 3 under the front bed frame 1 are actuated by the elastic cord 8 which is pulled by the movable frame 5 in motion, thereby causing the pivoting portion 1A of the front bed frame 1 and the rear bed frame 2 to bulge, as shown in FIG. 3. The backbone A2 of the user A of the exercise bed of the present invention is therefore braced and extended.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An exercise bed comprising a front bed frame and a rear bed frame fastened pivotally with said front bed frame such that said front bed frame and said rear bed frame are supported respectively by a support frame which is in turn provided with a plurality of support wheels fastened pivotally therewith, said rear bed frame provided with a movable frame on which a roller adjusting set is mounted, said rear bed frame further provided in the underside thereof with a transmission motor having a moving rod which is connected with said movable frame, said rear bed frame further provided thereunder with an elastic cord which is run through a rotary wheel located under said movable frame and a rotary wheel of said support frame and then connected to said front bed frame, said moving rod being actuated by said motor to drive said movable frame, thereby causing said rotary wheels of said front bed frame to move toward said rear bed frame to result in the bulging of a pivoting portion of said front bed frame and said rear bed frame.

2. The exercise bed as defined in claim 1, wherein said roller adjusting set has a fastening rod to which a plurality of soft rollers are fastened, said fastening rod being fastened with said movable frame such that a support rod of said roller adjusting set can be adjusted by a rotary wheel to ascend or descend gradually so as to hold both feet of a person between two roller sets located at different levels and both soles of the person between another two roller sets located at different levels.

3. The exercise bed as defined in claim 1, wherein one of said two support frames is fastened pivotally with said rear bed frame such that said one support frame can be adjusted in length so as to tilt the exercise bed.

* * * * *